US010060084B2

(12) United States Patent
Gencer

(10) Patent No.: US 10,060,084 B2
(45) Date of Patent: Aug. 28, 2018

(54) HOT ASPHALT PREPARATION SYSTEM AND METHOD FOR PRODUCING A NEW ASPHALT LAYER FROM THE ASPHALT TO BE RECYCLED

(71) Applicant: E-MAK MAKINA INSAAT TICARET VE SANAYI A.S, Bursa (TR)

(72) Inventor: Mehmet Nezir Gencer, Bursa (TR)

(73) Assignee: E-MAK MAKINA INSAAT TICARET VE SANAYI A.S., Bursa (TR)

( * ) Notice: Subject to any disclaimer, the term of this patent is extended or adjusted under 35 U.S.C. 154(b) by 842 days.

(21) Appl. No.: 14/062,975

(22) Filed: Oct. 25, 2013

(65) Prior Publication Data

US 2014/0112090 A1 Apr. 24, 2014

Related U.S. Application Data

(63) Continuation of application No. PCT/EP2012/062197, filed on Jun. 25, 2012.

(51) Int. Cl.
*E01C 19/00* (2006.01)
*E01C 19/10* (2006.01)
*E01C 19/05* (2006.01)

(52) U.S. Cl.
CPC ..... *E01C 19/1004* (2013.01); *E01C 19/05* (2013.01); *E01C 19/1045* (2013.01)

(58) Field of Classification Search
CPC ..... E01C 19/1068; E01C 2019/1086; E01C 19/1045
See application file for complete search history.

(56) References Cited

U.S. PATENT DOCUMENTS 4,339,202 A * 7/1982 Hart ..... E01C 19/1013 366/15
5,320,426 A * 6/1994 Keylon ..... E01C 19/1036 366/25
7,566,162 B1 * 7/2009 Swanson ..... E01C 19/1004 366/15

OTHER PUBLICATIONS

TR 2011/02838 to Ulusal Basvuru with a grant date of Aug. 22, 2016 and no publication date.*

* cited by examiner

*Primary Examiner* — Tony G Soohoo
*Assistant Examiner* — Anshu Bhatia
(74) *Attorney, Agent, or Firm* — Inventa Capital PLC

(57) ABSTRACT

Hot asphalt recycling system having a mixing hopper where the hot aggregate, exiting the drier, and the RAP are mixed; a pouring hopper which is opened to said mixing hopper from one end thereof and from whose other end RAP is poured, in order to obtain recycled asphalt concrete which is to be used in the production of one of the asphalt layers by using RAP. Said system comprising an air inlet pipe whose one end is connected to the heat source and whose other end is opened to the pouring hopper in order to transfer hot air, which is heated by a heat source, inside the pouring hopper; and at least one drying box in order to provide the RAP inside the pouring hopper to be poured to the mixing hopper in a sequenced manner and step by step.

15 Claims, 3 Drawing Sheets

HOT ASPHALT PREPARATION SYSTEM AND METHOD FOR PRODUCING A NEW ASPHALT LAYER FROM THE ASPHALT TO BE RECYCLED

CROSS-REFERENCE TO RELATED APPLICATION

This is a Continuation application of PCT Patent Application PCT/EP2012/062197 filed on Jun. 25, 2012, which claims the priority benefit of Turkish Patent Application Serial No. 2011/02838, filed Apr. 28, 2011, which is hereby incorporated herein by reference.

TECHNICAL FIELD

The present invention relates to asphalt recycling systems which provide the asphalt layer (RAP), which is desired to be recycled by being removed from the place thereof, to be converted into recycled asphalt concrete (RAC), and particularly relates to asphalt recycling systems with respect to the prior art part of Claim 1.

BACKGROUND

As known, asphalt concrete obtained from the aggregate and bitumen mixture is used in the form of different layers like corrosion layer, binder, straightening layer and base layers on road's upper structure. Each of these layers is produced by means of recipes prepared in laboratory with respect to the methods of international standards in order to provide different performance requirements. Different performances expected from each layer are provided by means of recipes prepared by different maximum particle dimension, different gradation and different bitumen proportions. These performance requirements are valid also for the layers to be realized using the recycled asphalt concrete (RAC).

Asphalt concrete which is applied to roads should be removed after certain usage duration (after the asphalt concrete completes the lifetime thereof). Today, because of the environmental conditions, removed asphalt concrete should be recycled and used in the production of new asphalt concrete. Moreover, recycling of the removed asphalt concrete (hereafter it will be called RAP) and the usage thereof in the production of new asphalt concrete provides economic advantages. As the removed asphalt proportion used in the production of new asphalt concrete increases, the economic advantage provided increases more.

Thus, in the related technical field, recycling can be realized by the usage of removed (RAP) asphalt concrete in the production of new asphalt concrete. In the present art, there are pluralities of technological recycling methods used for the recycling of asphalt.

Whatever the recycling method, the recycling of the RAP and the proportion of the RAP in the new mixture depends on maximum granule dimension, gradation and the bitumen proportion included and the results of the measurement of the aging and fatigue characteristics of the bitumen included. The removed asphalt concrete can be added with the proportion that the new mixture can provide the desired performance characteristics.

One of the most frequently used recycling method is the adding of the removed asphalt concrete, in hot form and in determined proportions, to the new asphalt mixture realized in the asphalt plant mixer. This method is called hot recycling. Here the important factors are the RAP amount and the method of mixing the RAP to the aggregate. The RAP should be mixed to the aggregate in a slow and controlled manner and at the optimum temperature.

In the patent application U.S. Pat. No. 4,279,592, a heat exchanger is disclosed which is used for pre-heating intake air for rotary drier. In the pre-heating hopper provided in the subject matter invention, air is circulated and afterwards, said air is transferred to the air inlet of the combustion hopper by means of a pipe. Said pre-heating hopper is assembled above the rotary drier and it has a curved form.

In the patent application JP2005290685, a deodorizing drier is disclosed. Said drier is used in deodorization of gas which is exhausted from a heating drum for heating and regenerating paving aggregate waste in a recycle plant. Here, deodorizing drier carries out continuous deodorization over a long period of time and at the same time carries out heating and drying of the paving aggregate. Accordingly, the deodorizing drier comprises a storage hopper arranged in some midpoint of an exhaust channel regarding the exhaust gas exiting the heating drum; a paving aggregate feeder for feeding the paving aggregate to the storage hopper; a paving aggregate discharging device for discharging the paving aggregate in a predetermined amount from the storage hopper; and a control mechanism in order for the paving aggregate feeder to control the feeding amount of the paving aggregate such that the storage hopper stores therein a constant amount of the paving aggregate. The deodorizing drier carries out deodorization of the exhaust gas by the paving aggregate in the storage hopper and carries out heating and drying of the paving aggregate in the storage hopper by waste heat of the exhaust gas.

SUMMARY OF THE INVENTION

The present invention is a hot asphalt recycling system, which eliminates the abovementioned problems and which brings new advantages to the related technical field.

An object of the present invention is to obtain recycled asphalt concrete, in order to be used in new asphalt concrete production, by providing the RAP to be heated by consuming less power and in a more regular manner and by joining RAP with hot aggregate.

Another object of the present invention is to provide a system which brings the RAP and aggregate to the process temperature and which takes the humidity in the RAP or in the aggregate and thereby which provides the RAP or aggregate to be dried.

In order to realize all of the abovementioned objects, the present invention is a hot asphalt recycling system comprising a mixing hopper where the hot aggregate, exiting the drier, and the RAP are mixed; and a pouring hopper which is opened to said mixing hopper from one end thereof and from whose other end RAP is poured, in order to obtain recycled asphalt concrete which is to be used in the production of one of the asphalt layers by using RAP. Said system comprises an air inlet pipe whose one end is connected to the heat source and whose other end is opened to the pouring hopper in order to transfer hot air, which is heated by a heat source, inside the pouring hopper; and at least one drying box in order to provide the RAP inside the pouring hopper to be poured to the mixing hopper in a sequenced manner and step by step.

In a preferred embodiment of the subject matter invention, there is a separator which is positioned between the pouring hopper and the air outlet pipe, in order to provide the precipitation and accumulation of the RAP particles in powder form existing inside the pouring hopper.

In a preferred embodiment of the subject matter invention, there is a separator which is positioned between the pouring hopper and the air outlet pipe, in order to provide the precipitation and accumulation of the RAP particles in powder form existing inside the pouring hopper.

In another preferred embodiment of the subject matter invention, said drying boxes are sequenced one under the other on the first line and on the second line of the pouring hopper so that at least some parts thereof will coincide in the vertical axis in the pouring hopper.

In another preferred embodiment of the subject matter invention, said drying boxes are sequenced one under the other on the first line of the pouring hopper.

In another preferred embodiment of the subject matter invention, said drying boxes are positioned one under the other on the second line so as to correspond between the drying boxes which are positioned one under the other on the first line.

In another preferred embodiment of the subject matter invention, said drying boxes are connected inside the pouring hopper so that the drying boxes will move in the pouring direction around a shaft from the middle part thereof.

In another preferred embodiment of the subject matter invention, there is a drive member which drives the shaft, in order to partially rotate the drying boxes, existing on the first line, in the pouring direction and in order to bring the drying boxes from the waiting position to the pouring position or from the pouring position to the waiting position.

In another preferred embodiment of the subject matter invention, there are pluralities of openings at the bottom part of the drying box, in order to provide heating of the RAP by circulating the hot air through the drying box.

In another preferred embodiment of the subject matter invention, there is a comb which has pluralities of teeth entering between said openings, in order to remove the RAP accumulated between the openings.

In another preferred embodiment of the subject matter invention, the drying boxes, existing on the first line, are partially rotated by a drive motor and said drying boxes are brought to the pouring position from the waiting position and the RAP is poured onto the drying boxes which exist in waiting position on the second line.

In another preferred embodiment of the subject matter invention, the drying boxes, existing on the second line, are partially rotated by a drive motor and said drying boxes are brought from the waiting position to the pouring position and the RAP is poured onto the drying boxes which exist in waiting position on the first line.

In another preferred embodiment of the subject matter invention, there is a sensor which measures the temperature of the mixture which exits from said pouring hopper and which is accumulated in the mixture hopper.

In another preferred embodiment of the subject matter invention, there is a control unit which adjusts the waiting duration of the drying box in the waiting position according to the temperature value received from the sensor; and which provides the RAP to be heated more or less.

In another preferred embodiment of the subject matter invention, the hot air is provided from a waste hot gas.

In another preferred embodiment of the subject matter invention, the hot air is heated using the exhaust output of the drier.

In another preferred embodiment of the subject matter invention, there is a rotary valve which provides the RAP to be poured from the RAP depot into the pouring hopper in a controlled manner and without cold air intake.

In another preferred embodiment of the subject matter invention, said rotary valve comprises a RAP input compartment facing the RAP depot and a RAP output compartment facing the pouring hopper.

The present invention is a hot asphalt recycling method, in order to obtain the RAC, which is to be used in the production of one of the asphalt layers, by using RAP, characterized by comprising the steps of:

a) The RAP, exiting the RAP feeding unit, is carried onto the pouring hopper; and said RAP is fed into the pouring hopper in a controlled manner,
b) The hot air, which is heated from a heat source, is applied into the pouring hopper; and said hot air is drawn by means of a vacuum from the bottom so that the hot air enters into the pouring hopper,
c) The RAP is poured into the mixing hopper step by step so that the RAP is waited inside said pouring hopper for a limited duration,
d) The air inside the pouring hopper is exhausted through the exhaust outlet of the drier,
e) The RAP, which is heated while it is being poured from the pouring hopper, is mixed in the mixing hopper with the aggregate exiting the drier.

In another preferred embodiment of the subject matter method, said step (a) comprises the following process step: the temperature of the mixture, which exits the pouring hopper and which is accumulated from the mixing hopper, is measured by a sensor.

In another preferred embodiment of the subject matter method, said step (a) comprises the following process step: according to the temperature value received from the sensor, the waiting duration of the drying box in the waiting position is adjusted, and by a control unit, the heating (less heating or more heating) of the RAP is controlled.

In another preferred embodiment of the subject matter method, said step (c) comprises the following process step: the RAP, which exists inside the drying box hopper positioned one under the other on the first line of the pouring hopper, is poured into the drying box hopper positioned on the second line and said RAP is transferred to the mixing hopper step by step.

In another preferred embodiment of the subject matter method, said step (c) comprises the following process step: the drying boxes are sequenced one under the other on the first line of the pouring hopper.

In another preferred embodiment of the subject matter method, said step (c) comprises the following process step: the drying boxes are positioned one under the other on the second line so as to correspond between the drying boxes which are positioned one under the other on the first line.

In another preferred embodiment of the subject matter method, said step (e) comprises the following process step: before hot air is exhausted through the exhaust outlet, the RAP powder particles are precipitated and they are accumulated in a separator.

In order for the embodiment and the advantages of the subject matter invention to be understood in the best manner with the additional elements, it has to be evaluated with the figures explained below.

DETAILED DESCRIPTION OF THE INVENTION

In this detailed description, the embodiment of the subject matter hot asphalt recycling system is explained with references to the annexed figures without forming any restrictive effect in order to make the subject more understandable.

Figure 1A:
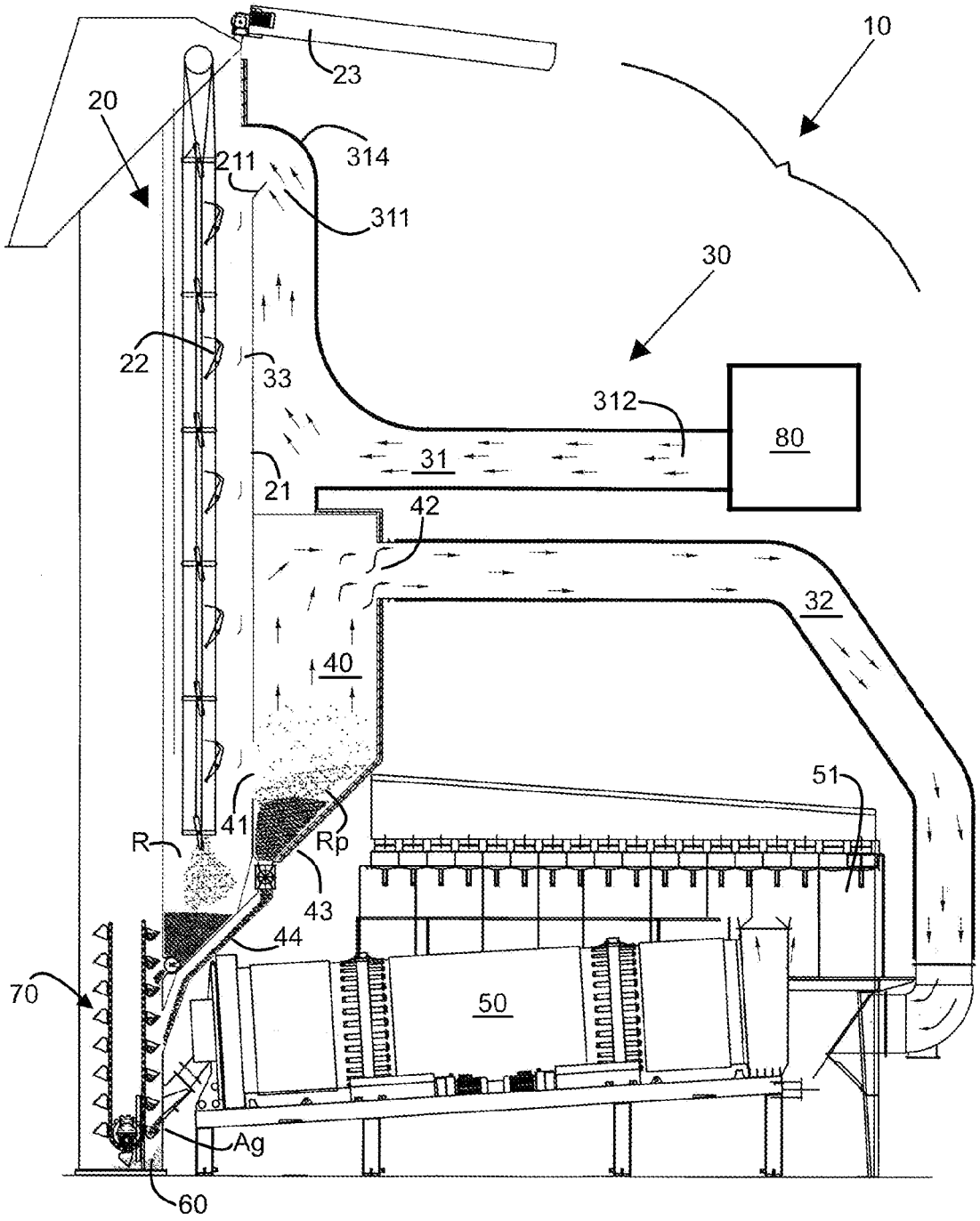
In FIG. 1*a*, a representative view of the heating method of the subject matter asphalt recycling system is given.
Figure 1B:
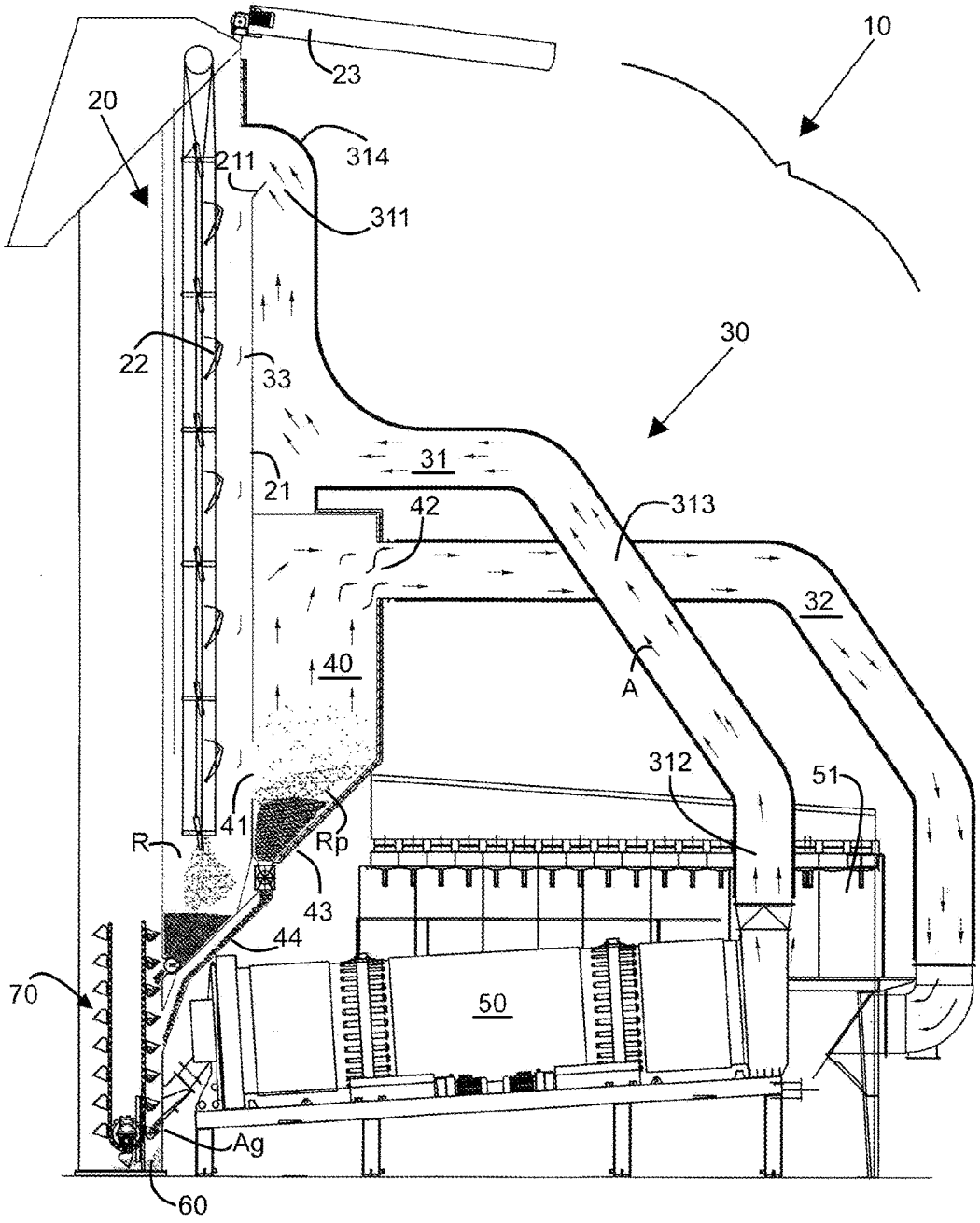
In FIG. 1*b*, a representative view of the alternative embodiment of the heating method of the subject matter asphalt recycling system is given.

With reference to FIG. 1, the subject matter hot asphalt recycling system's hot RAP and hot aggregate mixing system and mixing method in an asphalt plant (10) is described. First of all, the aggregate, existing inside the aggregate silos (not illustrated in the figure) in the aggregate feeding unit, is transferred into a drier (50) by means of a conveyor. Inside said drier (50), there is a rotary drum and the aggregate is heated by applying hot air into the drum. The aggregate, exiting the drier (50), is poured into the mixing hopper (60).

For the RAP, there is a pouring hopper (20) where the RAP is carried by means of a conveyor (23) from the RAP silo (not illustrated in the figure) existing in the RAP feeding unit, and where the RAP is poured downwardly in the vertical direction into the mixing hopper (60). One end of the pouring hopper (20) is opened to the mixing hopper (60). The pouring hopper (20) extends upwardly in the vertical direction from the mixing hopper (60). The pouring hopper (20) can have a cylindrical form or in the form of a rectangular prism. The RAP is poured from the pouring hopper (20) to the mixing hopper (60) in a controlled manner so as to wait for certain duration. In order to provide this, there are drying boxes (22) which are positioned inside the pouring hopper (20).

In the subject matter application, there is a heating system (30) for heating the RAP. Said heating system (30) comprises an air inlet pipe (31) for directing the hot air, exiting from a heat source (80), to the pouring hopper (20). The air inlet pipe (31) is connected to the heat source (80) from one end thereof (312). The other end thereof (311) is opened towards the pouring hopper (20). The hot air advances towards the mixing hopper (60) from the upper part of the pouring hopper (20). In order to provide this, there is a vacuum under the pouring hopper (20) and the hot air is drawn by means of vacuum. By means of this, the hot air advances by passing through each point of the pouring hopper (20) and through inside, upper side and lateral side of the drying boxes (22) inside the pouring hopper (20).

There is a directing part (211) on the wall (21) of the pouring hopper (20). The directing part (211) directs the hot air towards the end part (311) of the air inlet pipe (31). There is a curved part (314) at the end part of the air inlet pipe (31). The hot air enters the pouring hopper (20) through said curved part (314).

Particles, which are in powder form, exit the RAP heated inside the pouring hopper (20). There is a separator (40) for precipitating and accumulating said powder particles. Said separator (40) is positioned in a vertical manner at the lateral part of the pouring hopper (20). The separator (40) comprises an inlet part (41) which is opened to the pouring hopper (20). The hot air passes to the separator (40) through the pouring hopper (20) by means of said inlet part (41). The cross section of the separator (40) is wider than the cross section of the pouring hopper (20); by means of this, when hot air enters into the separator (40), because of the cross section width, the speed of the hot air decreases and the powder particles, which move together with air, are precipitated. The separator (40) has a rectangular prism form. However, it can also have a helical form. There is an accumulation hopper (43) on the lower part of the separator (40); and the precipitated powder particles are accumulated here. Said powder particles are transferred to the mixing hopper (60) by means of a transfer pipe (44). The hot air exits from the outlet part (42) of the separator (40). The outlet part (42) is opened to the air outlet pipe (32). By means of this, the hot air passes through the separator (40) and afterwards, the hot air arrives at the exhaust outlet (51) of the drier (50) through the air outlet pipe (32). There is a filter at the exhaust outlet (51). By means of this, the hot air is filtered through the filter and it is given out to the atmosphere. Thus, the dirty air output to the atmosphere is prevented.

After hot RAP and hot aggregate are mixed in the mixing hopper (60); by means of a vertical elevator (70), the mixture is taken and it is carried to the mixer of the asphalt plant (10). Thus, the RAP is heated in the desired manner and it is mixed with hot aggregate.

Figure 2B:
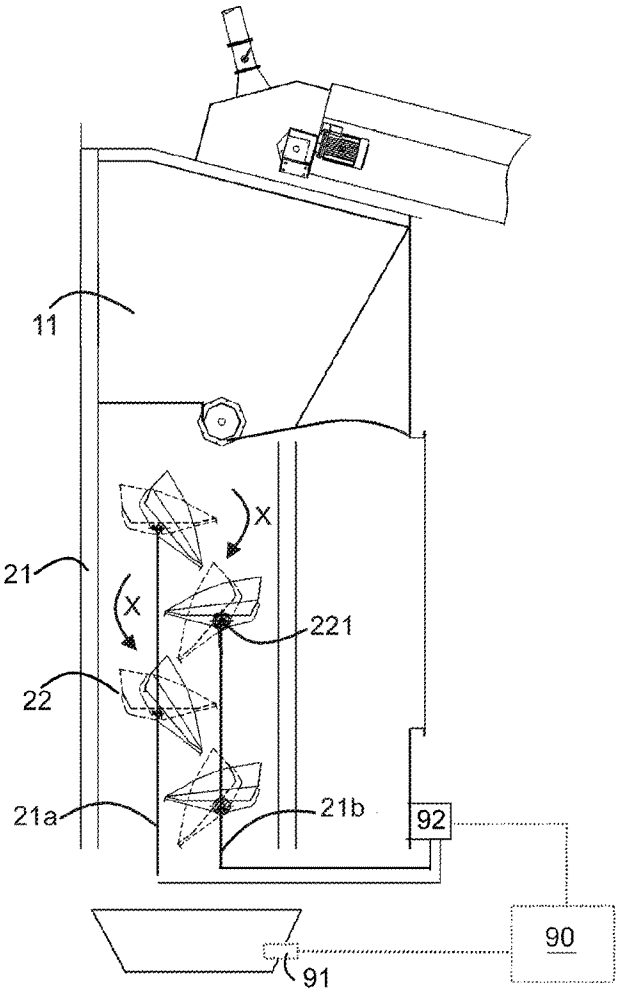
In FIG. 2*b*, the representative view of the movements of the drying boxes is given.
Figure 2A:
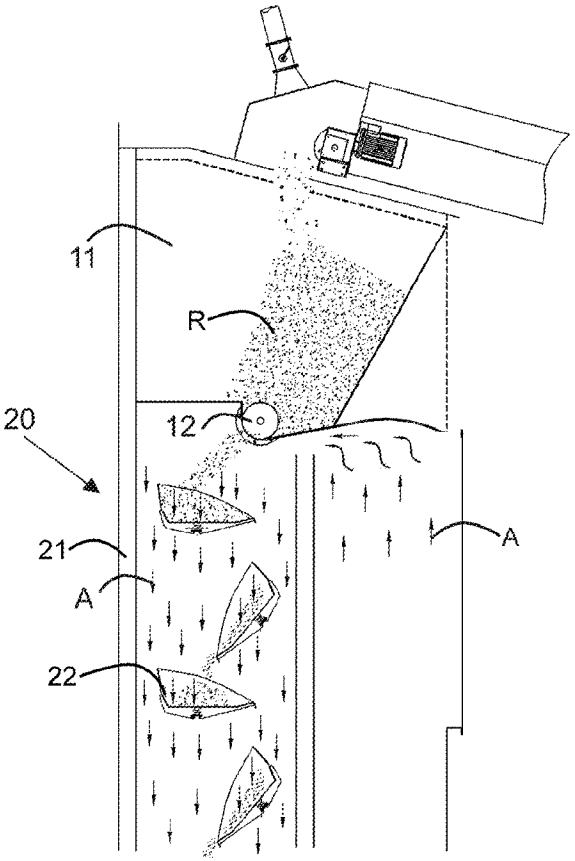
In FIG. 2*a*, the detailed view of the inner part of the pouring hopper is given.

With reference to FIGS. 2*a* and 2*b*, the abovementioned drying box (22) has a basket-like form and it comprises a hopper form wherein some of the RAP can be accumulated. The drying boxes (22) are sequenced so as to be mutual and so as to be one above the other inside the pouring hopper (20) in the distance from the upper part of the pouring hopper (20) until the mixing hopper (60). The drying boxes (22), existing on the first line (21*a*) and the second line (21*b*) of the pouring hopper (20), are sequenced so that some parts thereof will coincide in the vertical direction. The drying boxes (22) are connected onto a shaft (221) by means of a hinge from the middle points thereof on the first line (21*a*). When a force is applied to the shaft (221) by means of the drive member (92), the drying box (22) rotates in the pouring direction (X). When the RAP is poured into the pouring hopper (20) from the upper part thereof, the RAP is accumulated in the hopper of the drying box (22). After certain time duration, the drying box (22) is rotated as much as required in the pouring direction (X), the RAP inside is provided to be poured into the hopper of the drying box (22) which exists at the bottom. Afterwards, the drying box (22) whereon RAP is poured is again rotated in the pouring direction (X) after certain time duration; and the RAP inside the hopper is provided to be poured into the hopper of the drying box (22) which exists at the bottom. The RAP continues these processes in a sequenced manner, and it finally reaches the mixing hopper (60). The drying boxes (22) are sequenced so as to be mutual and so as to be one under the other on the first and second line (21*a*, 21*b*) of the pouring hopper (20). The drying boxes (22) on the first line (21*a*) firstly stay in the waiting position. Afterwards, by means of a drive motor, the drying boxes (22) existing on the first line (21*a*) are rotated in the pouring direction (X) as required, and thereby the drying boxes (22) are brought to the pouring position. The RAP, existing inside the drying boxes (22), is poured into the hopper of the drying boxes (22) which are sequenced on the second line (21*b*) and which stay in the waiting position. Afterwards, the drying boxes (22), existing on the second line (21*b*), are rotated from the waiting position towards the pouring position by means of a drive motor. In this case, the RAP, existing in the hopper of the drying box (22) existing on the second line (21*b*), is poured onto the drying boxes (22) which stay in the waiting position on the first line (21*a*). By means of this, the RAP passes from the drying boxes (22) which are sequenced on the first line (21*a*) to the drying boxes (22) which are sequenced on the second line (21*b*) and afterwards, the RAP passes from the drying boxes (22) existing on the second line (21*b*) to the drying boxes (22) existing on the first line (21*a*); and the RAP advances until the mixing hopper (60) in a sequenced manner.

The hopper of the drying box (22) is in the form of a grid with holes through which hot air can pass. After RAP is poured to the hopper of the drying box (22), hot air, which is drawn by hot vacuum, is passed through said grid holes, and the hot air moves inside the pouring hopper (20) in the flow direction. The back part of the drying box (22) has a perforated form. The hot air passes through the holes on said back part and it easily advances inside the pouring hopper (20). When the RAP, which exists inside the drying box (22), is poured into the drying box (22) which exists at the bottom, the RAP can enter into the grid holes of the drying box (22) and can remain there. There are combs for removing the RAP entering between the grid holes. Said combs enter into the grid holes, and RAP is provided to be removed from between the grid holes. The number of combs is equal to the number of grid holes.

In order to provide the RAP to discharge into the pouring hopper (20) in a controlled manner, the RAP is transferred to a RAP depot (11) from the conveyor (23). The RAP depot (11) is positioned at the upper part of the pouring hopper (20). The RAP is firstly transferred to the RAP depot (11), afterwards, it is poured into the pouring hopper (20) from here. There is a rotary valve (12) which provides the RAP to be stopped and to be poured again while the RAP is being poured from the RAP depot (11) to the pouring hopper (20). The rotary valve (12) has compartments facing the RAP depot (11) and the pouring hopper (20). The RAP, flowing from the conveyor (23), fills in the compartments of the valve (12) in sequence. While the rotary valve (12) rotates around the own axis thereof, the RAP, which fills in the compartments thereof, is transferred inside the pouring hopper (20) in sequence. By means of this, for instance when the drying boxes (22) existing on the first line (21*a*) are in waiting position, RAP is transferred to the drying boxes (22) from the compartment of the rotary valve (12). Afterwards, when the drying boxes (22) are in pouring position, the rotary valve (12) rotates as required and the inlet part of the RAP depot (11) is covered and thus the RAP does not flow. By means of the rotary valve (12), while the drying boxes (22) are in pouring position, the RAP flow from the RAP depot (11) is prevented. By means of the rotary valve (12), the pouring hopper (20) and the RAP depot (11) are connected in an air-tight manner, and feeding is provided without cold air input to the pouring hopper (20).

There is a sensor (91) which measures the temperature of the aggregate and of the RAP accumulated in the mixing hopper (70). Said sensor (91) is in connection with a control unit (90). The control unit (90) adjusts the waiting time duration of the drying boxes (22), which are in waiting position, according to the temperature of the mixture in the mixing hopper. For instance, if the temperature of the mixture is not at the desired temperature value, the drying boxes (22) stay in the waiting position for longer time duration. Thus, the optimum temperature value is provided.

In the subject matter application, hot air, which exits the drier (50), is used as the heat source (80). However, in alternative embodiments, hot air may not be provided by the drier (50), and it may be provided by another heat source (80). For instance, temperature can also be provided by the hot air coming from the waste air exhaust gas outlet or temperature can also be provided by a separate heat source (80) which is embodied for this process.

The invention claimed is:

1. A hot asphalt recycling system having a mixing hopper (60) where hot aggregate, exiting a drier, and RAP are mixed; a pouring hopper (20) including a wall (21) extending to a directing part (211) which is opened to said mixing hopper (60) from one end thereof and from whose other end RAP is poured, in order to obtain recycled asphalt concrete which is to be used in the production of one of the asphalt layers by using RAP, characterized by comprising an air inlet pipe (31) whose one end (312) is connected to a heat source (80) and whose other end (311) is opened to the pouring hopper (20) in order to transfer hot air, which is heated by the heat source (80), inside the pouring hopper (20) wherein the directing part (211) directs the hot air towards the end part (311); and at least one drying box (22) in order to provide the RAP inside the pouring hopper (20) to be poured to the mixing hopper (60) in a sequenced manner and step by step.

2. A hot asphalt recycling system according to claim 1, characterized in that there is a separator (40) which is positioned between the pouring hopper (20) and an air outlet pipe (32), in order to provide precipitation and accumulation of RAP particles in powder form existing inside the pouring hopper (20).

3. A hot asphalt recycling system according to claim 1, characterized in that the at least one drying box (22) are sequenced one under the other on the first line (21*a*) and on the second line (21*b*) of the pouring hopper (20) so that at least some parts thereof will coincide in a vertical axis in the pouring hopper (20).

4. A hot asphalt recycling system according to claim 1, characterized in that at least one drying box (22) is connected inside the pouring hopper (20) so that the at least one drying box (22) will move in the pouring direction around a shaft from a middle part thereof.

5. A hot asphalt recycling system according to claim 4, characterized in that there is a drive member (92) which drives the shaft (221), in order to partially rotate the at least one drying box, existing on a first line (21*a*), in the pouring direction (X) and in order to bring the at least one drying box (22) from a waiting position to a pouring position or from the pouring position to the waiting position.

6. A hot asphalt recycling system according to claim 1, characterized in that there are pluralities of openings at a bottom part of the at least one drying box (22) in order to provide heating of the RAP by circulating the hot air through the drying box (22).

7. A hot asphalt recycling system according to claim 6, characterized in that there is a comb which has pluralities of teeth entering between said openings, in order to remove the RAP accumulated between the openings.

8. A hot asphalt recycling system according to any claim 1, characterized in that, the at least one drying box (22), existing on a first line (21*a*), are partially rotated by a drive motor and said at least one drying box is brought from a waiting position to a pouring position and the RAP is poured onto the at least one drying box (22) which exists in the waiting position on a second line (21*b*).

9. A hot asphalt recycling system according to claim 5, characterized in that, the at least one drying box (22) existing on a second line (21*b*) are partially rotated by a drive motor and the at least one drying box (22) is brought to the pouring position from the waiting position and the RAP is poured onto the at least one drying box (22) which exist in waiting position on the first line (21*a*).

10. A hot asphalt recycling system according to claim 1, characterized by comprising a sensor (91) which measures temperature of a mixture which exits from said pouring hopper (20) and which is accumulated in the mixture hopper.

11. A hot asphalt recycling system according to claim 9, characterized by comprising a control unit (90) which adjusts a waiting duration of the at least one drying box (22) in the waiting position according to the temperature value received from the sensor (91); and which provided the RAP to be heated more or less.

12. A hot asphalt recycling system according to claim 1, characterized in that the hot air is provided from a waste hot gas.

13. A hot asphalt recycling system according to claim 12, characterized in that the hot air is heated using an exhaust output to the drier.

14. A hot asphalt recycling system according to claim 1, characterized by comprising a rotary valve (12) which provides the RAP to be poured from a RAP depot (11) into the pouring hopper (20) in a controlled manner and without cold air intake.

15. A hot asphalt recycling system according to claim 14, characterized in that said rotary valve (12) comprises a RAP input compartment facing the RAP depot (11) and a RAP output compartment facing the pouring hopper (20).

* * * * *